US007198391B2

(12) United States Patent
Rutchik

(10) Patent No.: US 7,198,391 B2
(45) Date of Patent: Apr. 3, 2007

(54) COLLAR FOR A LIGHT FIXTURE

(76) Inventor: Jeff Rutchik, 32 Baltic Ave., North Easton, MA (US) 02356

( * ) Notice: Subject to any disclaimer, the term of this patent is extended or adjusted under 35 U.S.C. 154(b) by 113 days.

(21) Appl. No.: 10/894,515

(22) Filed: Jul. 19, 2004

(65) Prior Publication Data

US 2005/0013136 A1 Jan. 20, 2005

Related U.S. Application Data

(60) Provisional application No. 60/488,499, filed on Jul. 18, 2003.

(51) Int. Cl.
*F21V 15/00* (2006.01)
*F21V 11/00* (2006.01)
*F21V 17/06* (2006.01)
*F21S 13/02* (2006.01)

(52) U.S. Cl. ..... 362/365; 362/359; 362/443; 362/457

(58) Field of Classification Search ..... 362/434, 362/440, 365, 366, 147, 148, 359, 457, 443
See application file for complete search history.

(56) References Cited

U.S. PATENT DOCUMENTS 2,785,291 A * 3/1957 Bernstein ..... 362/255
3,696,238 A * 10/1972 Szymanski ..... 362/293
5,176,441 A * 1/1993 Horvath dr.nee Vegh et al. ..... 362/267
5,921,662 A * 7/1999 Bruckner et al. ..... 362/292
6,497,501 B1 * 12/2002 Harder ..... 362/359
6,830,362 B2 * 12/2004 Mullen ..... 362/455
6,832,846 B2 * 12/2004 Lagonegro ..... 362/359
6,957,896 B2 * 10/2005 Burgess ..... 362/147

* cited by examiner

*Primary Examiner*—Sandra O'Shea
*Assistant Examiner*—David Makiya
(74) *Attorney, Agent, or Firm*—Ostrolenk, Faber, Gerb & Soffen, LLP

(57) ABSTRACT

A collar for attachment to a recessed or high hat light fixture including an upper, annular flange at the attachment flange of the light fixture, a bottom annular flange spaced below the upper flange and a cylindrical collar between the flanges. Attachment clips supported by springs on the bottom flange are urged into attachment with the baffle flange of the fixture for attaching the collar. Additional elements may be attached to the bottom flange of the collar for functional or decorative purposes.

9 Claims, 3 Drawing Sheets

COLLAR FOR A LIGHT FIXTURE

CROSS-REFERENCE TO RELATED APPLICATION

This application is based on and claims priority to provisional application No. 60/488,499, filed Jul. 18, 2003, herein incorporated by reference.

BACKGROUND OF THE INVENTION

The invention concerns a collar for attachment below or outside the light emitting end of a light fixture, in particular, a recessed light fixture, commonly called a "high hat."

A high hat light fixture is typically installed in an opening in a ceiling or wall. The fixture includes a can in which the illumination source or light bulb is disposed and to which electricity is supplied. The opening in the ceiling or wall is sized or shaped to hold the periphery of the can.

The open outer end of the can terminates in a baffle flange or trim ring for the recessed light. That flange extends wider than the open end of the can and typically is at least near or rests against the outer, room facing surface of the ceiling or wall to which the baffle flange is conventionally attached to position the can. The baffle flange of the recessed light may be of metal or plastic or other finished material defining a trim ring. It completes the high hat and is used to complete the installation of the light can in the opening. Those elements of a high hat fixture are conventional. The collar of the invention is designed to cooperate with those elements for mounting the collar securely to the mounted recessed light fixture.

There are known baffle attachments to light fixtures for directing light beams, and lenses of glass or the like, for changing the colors or directing or focusing the light. These are typically disposed within the can of the recessed light fixture. Further, they are not universally applicable to all sizes and designs of such light fixtures.

SUMMARY OF THE INVENTION

It is the primary object of the invention to provide an attachment to a light fixture, particularly a recessed light fixture, for directing light downwardly or out of the fixture and/or to support additional elements, such as a decorative article, at the light fixture.

Another object of the invention is to enable the retrofitting of an installed recessed or high hat light fixture with the collar of the invention.

The collar of the invention includes an annular top or upper or inner flange received at or below the baffle flange or trim ring of the fixture, an annular bottom or outer flange spaced below or outward of the top part flange and to which additional elements may be attached, and an annular collar between the upper and bottom flanges for redirecting the light from the fixture through the collar.

A plurality of clips are adjustably attached to the collar, particularly to the bottom or outer flange. The clips are adjustable in their positions to be engageable on various size or shape baffle flanges or trim rings to hold the collar thereto. In a preferred embodiment, the adjustable attachment of the clips is by springs that support the clips and normally bias them into the attaching position.

The collar, and particularly its bottom flange, acts as a platform for attaching decorative or custom fixtures to the collar. Appropriate openings, slots attachment elements, and the like are provided on and in the bottom flange to accept for multiple options of materials and configurations to be attached to the collar. The collar has both residential and commercial applications and serves as a platform for attaching decorative or functional elements, including illuminated signage that is attached beneath the collar, ornamentation for a room, redirecting the light, lenses, geometric shape attachments, and any decorative item, or any other types of attachment without limitation as to type, except obvious weight and size limitations. The collar directs the light from the recessed light fixture down through the collar and illuminates whatever item is attached to the collar.

Other objects and features of the present invention will become apparent from the following description of a preferred embodiment in conjunction with the accompanying drawings.

DESCRIPTION OF A PREFERRED EMBODIMENT

Figures 1, 2, 3, 4, 5:
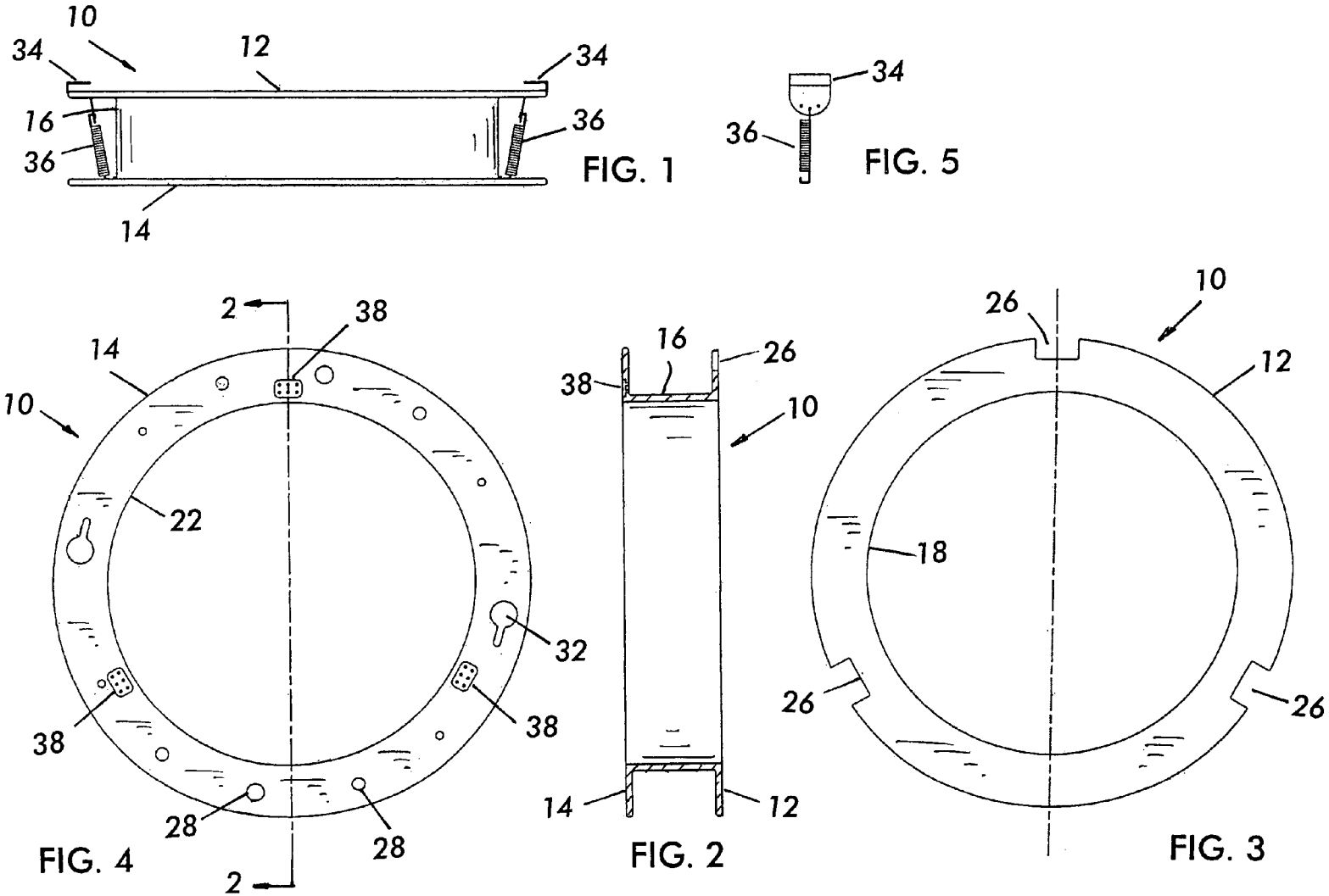
FIG. 1 is a side view of a light collar according to the invention.
FIG. 2 is a cross-section view of the collar portion without clips as shown at 2—2 in FIG. 4.
FIG. 3 is a top view of the collar.
FIG. 4 is a bottom view of the collar.
FIG. 5 is a side view of a spring shown in FIG. 1.

A light collar 10 according to the invention is shown in FIGS. 1–5. The light collar includes a preferably opaque, preferably injection molded, preferably plastic, collar 10 comprised of a top, upper or inner annular collar flange 12, a bottom, lower or outer annular collar flange 14 and an annular collar portion 16. In FIG. 2, it can be seen that the flanges 12 and 14 and the collar 16 are an integral plastic molding, although that is not required. Further, the collar 16 is cylindrical, although that is not required. A tapering, frusto-conical shape, or any other shape collar is possible. The flanges 12 and 14 are both shown as circular annulus in shape. But, each may be otherwise shaped, especially at their exterior edges. The central openings 18 in the upper flange and 22 in the bottom flange are preferably sized to correspond to the opening into the light fixture, preferably so as not to block light exiting the fixture. Although the collar 16 may be opaque, it may also be translucent or transparent, may have a reflective interior or not, and may be of plastic or metal or a combination thereof, or of other materials, so long as it cooperates in the transmission of light below the attached collar.

The upper flange has a plurality of notches 26 each providing clearance for a respective collar attachment clip, described below. The bottom flange is provided with a plurality of holes 28, mounting slots 32, and other attachment elements for enabling attachment of additional decorative or functional elements to the collar, as mentioned above and discussed further below. Selection of the attachment elements on the bottom flange 14 is a matter of choice.

Referring to FIGS. 1 and 5, the collar 10 is provided with a plurality of clips 34 by which the collar may be attached to the light fixture, as described below. Each of the clips is shown as a simple C-shaped part. It is attached to a respective flexing spring 36 that is in turn attached at a respective attachment fixture 38 on the bottom flange 14. The securement of the attachment fixture to the flange 14 and the resilience of the spring 36 normally urges the clip radially inwardly, but the clips can be pushed outwardly by the installer to enable the installation of the collar to the light fixture. Other modes of attachment of the clips would be apparent. The recesses 26 in the upper flange 12 are shaped and positioned to provide clearance for the springs 36 and the clips 34 to be moved radially inwardly, thereby increasing the range of diameters of the baffle flange or trim ring to which the collar 10 may be clipped.

Figure 6:
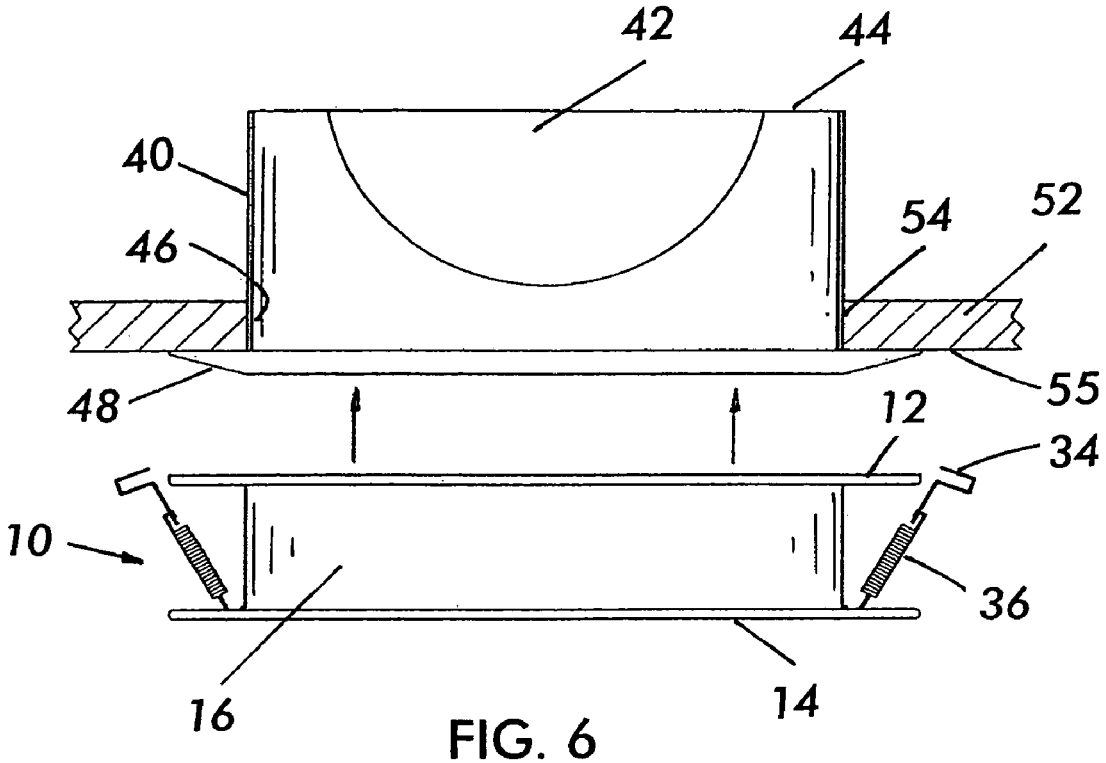
FIG. 6 shows the collar about to be attached to a light fixture.

FIG. 6 illustrates a typical known high hat type light fixture. It includes a "can", 42,42 in which a conventional electric light bulb is supported at the base 44 of the can and is electrified conventionally by connections to the bulb. The can has a standard exterior diameter. The outward or open edge 46 of the can 40 is finished with a baffle flange 48 for the recessed light fixture. That baffle flange is also annular and has an inner diameter at the edge 46 of the can so that the baffle flanges preferably do not interfere with the exit of illumination from the can 40. The light fixture can 40 and baffle flange 48 are conventional and are not part of the invention but are the parts with which the collar of the invention cooperates. The can 40 may be installed in a ceiling 52 or a wall having an opening 54 that is sized and shaped to the periphery of the can 44 for supporting the can. The baffle flange rests on the outward, room facing side 55 of the ceiling or wall 52. The foregoing is conventional for providing the light fixture to which the collar of the invention is attached.

Figure 7:
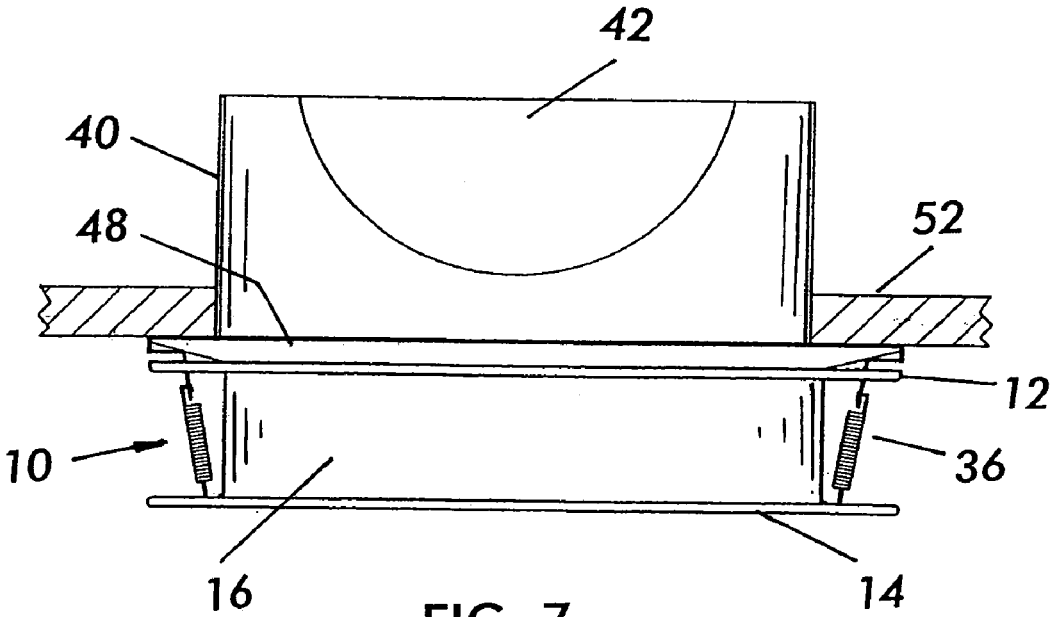
FIG. 7 shows the collar attached to the light fixture.

Referring to FIG. 6, to attach the collar 10, the clips 34 are urged outwardly. Then the collar is moved up so that the upper flange 14 rests against the underside of the baffle flange 48 and the clips 34 are positioned so that their C-shaped or hook ends engage the flange 48 between the flange and the outside 55 of the ceiling. Then the clips 34 are pushed inwardly and are retained in that position by a tight fit in the space between the baffle flange and the ceiling and also by the cooperation of the springs 36. A finished installation of the collar is illustrated in FIG. 7.

Figure 8:
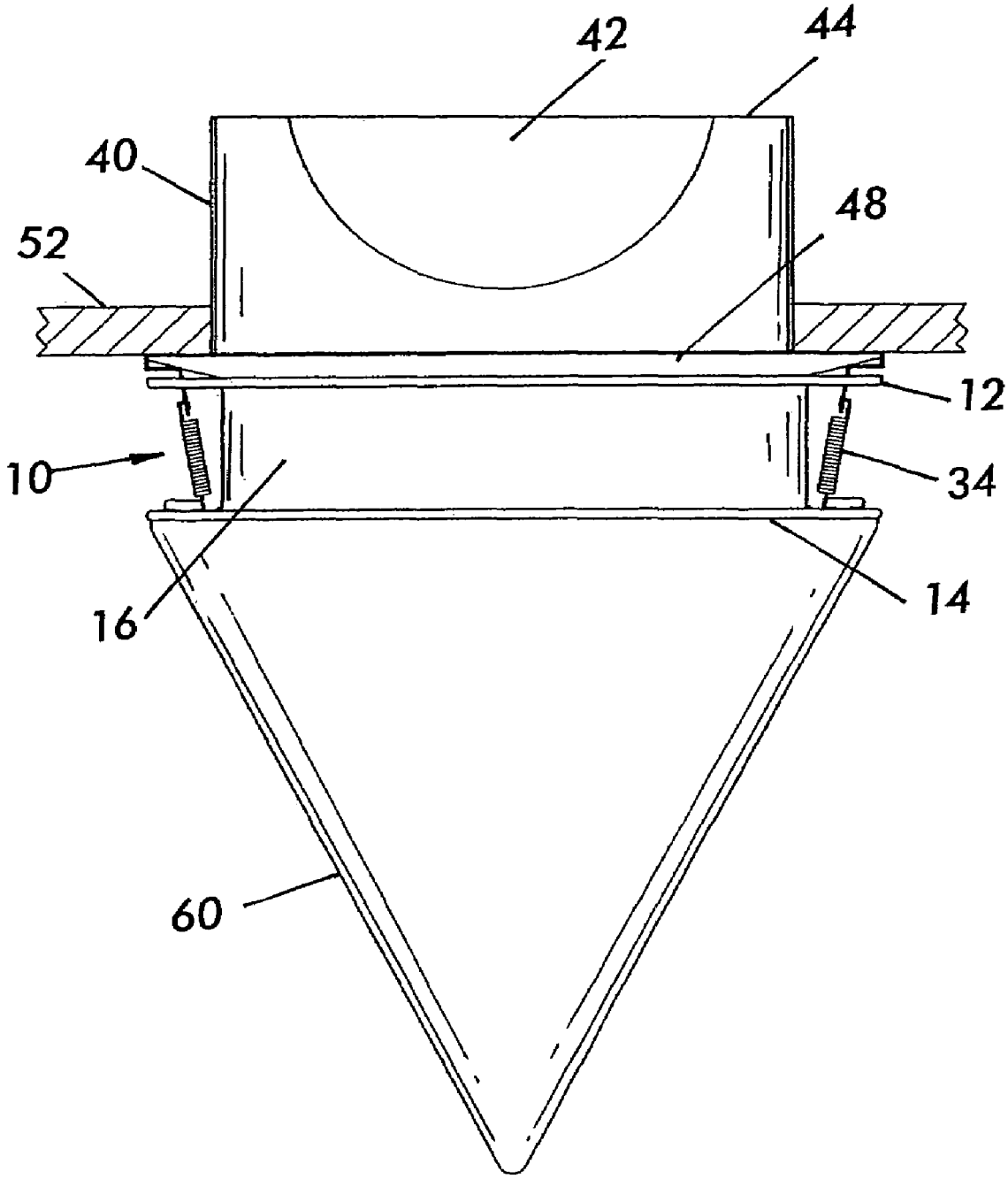
FIG. 8 shows a representational decorative cone attachment on the installed light collar.

FIG. 8 illustrates one of an infinite variety of attachments to the collar. Here, a simple decorative cone-shaped accent part 60 is attached in some manner to the underside of the bottom flange 16. This is but one of an almost infinite number of examples of different types of elements that may be attached to the collar and supported thereby.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A collar for a light fixture, wherein the light fixture comprises a baffle flange around an open side of the light fixture, the collar comprising:

an annular upper flange for being positioned toward the baffle flange of the fixture, an annular bottom flange spaced out from the upper flange;

a collar extending between the upper and the bottom flanges, and extending around those flanges and adapted to transmit light from the fixture that exits through the baffle flange to pass through an opening defined by the annular upper flange followed by an opening defined by the annular bottom flange;

an attachment fixture attached to the light collar, and with the upper flange at the baffle flange, the attachment fixture being shaped and positioned to attach to the baffle flange, thereby attaching the collar to the light fixture;

the attachment fixture comprises an attachable part attachable to the baffle flange and a spring connecting the attachable part to the collar enabling the attachable part to be movable radially outwardly or inwardly with respect to the collar and the baffle flange to enable the attachable part to be attached to various baffle flanges of various diameters, sizes and shapes; and the spring is attached to the bottom flange and extends up toward the upper flange and past the upper flange to urge the attachable part be received at the baffle flange of the light fixture.

2. The collar of claim 1, wherein the bottom flange includes attachment elements for enabling attachment of additional items to the bottom flange and to the collar.

3. The collar of claim 1, wherein the upper flange has a recess at the location of the attachable part providing space for larger radial movement of the attachable part for accommodating various size baffle flanges.

4. The collar of claim 1, wherein the upper flange, the bottom flange and the collar between the flanges are integral one piece.

5. The collar of claim 4, wherein the collar is a plastic molding.

6. The collar of claim 5, wherein the collar is opaque.

7. The collar of claim 6, wherein the collar is cylindrical in shape.

8. In combination, a light fixture having an open side through which light is emitted and a baffle flange around the open side of the light fixture, and the collar of claim 1 attachable by the attachment fixture to the baffle flange.

9. A collar for a light fixture, wherein the light fixture comprises a baffle flange around an open side of the light fixture, the collar comprising:

an annular upper flange for being positioned toward the baffle flange of the fixture, an annular bottom flange spaced out from the upper flange;

a collar extending between the upper and the bottom flanges, and extending around those flanges and adapted to transmit light from the fixture that exits through the baffle flange to pass through an opening defined by the annular upper flange followed by an opening defined by the annular bottom flange;

an attachment fixture attached to the light collar, and with the upper flange at the baffle flange, the attachment fixture being shaped and positioned to attach to the baffle flange, thereby attaching the collar to the light fixture;

the attachment fixture comprises an attachable part attachable to the baffle flange and a spring connecting the attachable part to the collar enabling the attachable part to be movable radially outwardly or inwardly with respect to the collar and the baffle flange to enable the attachable part to be attached to various baffle flanges of various diameters, sizes and shapes; and the upper flange has a recess at the location of the attachable part providing space for larger radial movement of the attachable part for accommodating various size baffle flanges.

* * * * *